US005489397A

United States Patent [19]

Bainbridge

[11] Patent Number: 5,489,397

[45] Date of Patent: Feb. 6, 1996

[54] AQUEOUS LAMELLAR DETERGENT COMPOSITIONS WITH HYDROPHOBICALLY TERMINATED HYDROPHILIC POLYMER

[75] Inventor: Peter Bainbridge, Signal Mountain, Tenn.

[73] Assignee: National Starch and Chemical Investment Holding Corporation, Wilmington, Del.

[21] Appl. No.: 206,782

[22] Filed: Mar. 4, 1994

[51] Int. Cl.[6] ..... C11D 3/37; C11D 3/04; C11D 17/08; C11D 3/34

[52] U.S. Cl. ..... 252/174.24; 252/174.23; 252/174; 252/173; 252/121; 252/549; 252/DIG. 2; 252/DIG. 4; 252/DIG. 14

[58] Field of Search ..... 252/174.23, 174.24, 252/174, 173, DIG. 2, 121, 89.1, 549, DIG. 4, DIG. 14

[56] References Cited

U.S. PATENT DOCUMENTS

| | | | |
|---|---|---|---|
| 3,489,942 | 3/1970 | Dannals | 260/29.6 |
| 3,772,382 | 11/1973 | Dannals | 260/481 |
| 3,839,405 | 10/1974 | Dannals | 260/465.4 |
| 3,853,781 | 12/1974 | Haschke et al. | 252/132 |
| 3,887,480 | 6/1975 | Rue et al. | 252/135 |
| 3,896,086 | 7/1975 | Hasckke et al. | 260/67 |
| 3,922,230 | 11/1975 | Lamberti et al. | 252/89 |
| 4,663,071 | 5/1987 | Bush et al. | 252/174.19 |
| 4,797,223 | 1/1989 | Amick et al. | 252/174.23 |
| 4,814,102 | 3/1989 | Baur et al. | 252/174.24 |
| 4,873,012 | 10/1989 | Broze et al. | 252/99 |
| 4,874,537 | 10/1989 | Peterson et al. | 252/99 |
| 4,923,635 | 5/1990 | Simion et al. | 252/89.1 X |
| 4,980,088 | 12/1990 | Boeckh et al. | 252/DIG. 2 |
| 4,992,194 | 2/1991 | Liberati et al. | 252/DIG. 2 |
| 5,009,805 | 4/1991 | Perner et al. | 252/174.24 |
| 5,066,749 | 11/1991 | Leighton et al. | 252/174.24 X |
| 5,073,269 | 12/1991 | Denzinger et al. | 526/227 X |
| 5,073,285 | 12/1991 | Liberati et al. | 252/174.23 X |
| 5,110,506 | 5/1992 | Ciallella | 252/173 X |
| 5,126,069 | 6/1992 | Kud et al. | 252/174.23 |
| 5,132,053 | 7/1992 | Crossin | 252/546 |
| 5,147,576 | 9/1992 | Montague et al. | 252/174 |
| 5,273,676 | 12/1993 | Boeckh et al. | 252/174.21 X |
| 5,294,693 | 3/1994 | Egraz et al. | 526/310 |

FOREIGN PATENT DOCUMENTS

| | | |
|---|---|---|
| 971299 | 7/1975 | Canada . |
| 62-277498 | 12/1987 | Japan . |
| 1310730 | 12/1989 | Japan . |
| WO90/13622 | 11/1990 | WIPO . |
| WO91/09109 | 6/1991 | WIPO . |

OTHER PUBLICATIONS

J. van de Pas' PhD, "A Study of the Physical Properties of Lamellar Liquid–Crystalline Dispersions" (Rijksuniversiteit Groningen, The Netherlands, Jun. 25, 1993.

Uniroyal Technical Service Bulletin, "Polywet® Oligomeric Surfactants," Undated.

*Primary Examiner*—Douglas J. McGinty
*Attorney, Agent, or Firm*—William K. Wissing

[57] ABSTRACT

Liquid detergent compositions comprise hydrophobically-terminated, hydrophilic polymers as deflocculating agents, phase stabilizers, builders or co-builders and viscosity modifiers, in addition to detergent active material and electrolytes contained in an aqueous continuous phase.

18 Claims, No Drawings

AQUEOUS LAMELLAR DETERGENT COMPOSITIONS WITH HYDROPHOBICALLY TERMINATED HYDROPHILIC POLYMER

BACKGROUND

Liquid detergent compositions, particularly concentrated liquid detergent compositions for laundry use, must be formulated for shelf-stability during manufacturing, distribution and consumption by the ultimate consumer.

Liquid detergent compositions are formulated with surfactants and other detergent active materials and detergency builders (typically comprising dissolved electrolyte) and, optionally, solid particles, which are dispersed in a continuous aqueous phase. The surfactant used in the liquid detergent compositions may exist in the form of lamellar droplets contained in a lamellar dispersion having a desirable turbid appearance and a sufficiently low viscosity to flow when poured by a consumer. Appropriate lamellar dispersions are described in U.S. Pat. No. 5,147,576, Montague et al., issued Sep. 15, 1992, which is hereby incorporated by reference.

The addition of materials such as the traditional polyacrylates or acrylate/maleate copolymers as builders or co-builders has been observed to disturb the desirable rheology of the lamellar dispersion required in liquid detergent compositions. The incompatibility of traditional polyacrylates and acrylate/maleate copolymers in liquid detergent formulations has been a particular problem in concentrated liquid detergent formulations. "Concentrated liquid detergent" formulations contain a higher percent surfactant or detergent active material than traditional liquid detergent compositions, i.e., at least about 25% detergent active materials.

U.S. Patent No. 5,147,576, discloses a deflocculating polymer consisting of a hydrophilic backbone with hydrophobic side chains which deflocculating polymer permits the formulation of concentrated liquid detergent compositions in the form of stable lamellar dispersions in a continuous aqueous phase. The deflocculating polymer permits incorporation of greater amounts of electrolytes than would otherwise be compatible with a liquid detergent composition having shelf-stability and the relatively low viscosity required by consumers. The deflocculating polymer provides stability in these liquid detergent compositions, whereas polymers traditionally used as stabilizers for emulsions do not perform as required in liquid detergent compositions.

It has now be found that liquid detergent compositions may be provided in a stable form comprising a lamellar dispersion of the detergent active materials in a continuous aqueous phase by the addition of a polymer having a hydrophilic backbone and a hydrophobic terminal group. Such a polymer may be economically and readily polymerized from materials such as acrylic acid and dodecyl mercaptan (DDM). Thus, these polymers provide a simple route to achieving stable liquid detergent compositions, particularly concentrated compositions.

Canadian Patent Number 971,299, issued Jul. 15, 1975, to Lamberti, et al., discloses the use in powdered detergents of an acrylate polymer, having at least one end of the polymer chain terminated with a sulfur-containing group or an hydroxy-containing group, as an organic builder. This builder is taught to be useful in place of phosphates. Copolymeric forms of the sulfur- group-terminated polymer are disclosed to be undesirable.

Thus, the benefits in liquid detergents of the hydrophobically-terminated, hydrophilic polymer disclosed herein are quite unexpected. In particular, the capacity of the polymers of this invention to maintain low viscosity, liquid phase stability and lamellar dispersions of surfactant in a continuous aqueous phase of a liquid detergent composition, particularly a concentrated composition, is unexpected.

SUMMARY OF THE INVENTION

This invention provides a liquid detergent composition comprising at least 25%, by weight, detergent active materials, at least 1%, by weight, electrolyte(s) contained in an aqueous continuous phase, and about 0.01 to 5%, by weight, deflocculating polymer, the deflocculating polymer being a hydrophobically-terminated, hydrophilic polymer having efficacy as a stabilizer. The liquid detergent compositions containing the deflocculating polymer yield no more than 2%, by volume, visual phase separation following storage at 25° C. for one month.

Suitable deflocculating polymers for use in the liquid detergent compositions comprise a repeating unit of the structure:

$$[A—B]_n—C,$$

wherein A and B are a polymerized residue of ethylenically unsaturated carboxylic acid monomer(s) selected from the group consisting of monocarboxylic acids, dicarboxylic acids, and their salts, anhydrides and esters, and A and B may be identical or different, C is a terminal hydrophobic moiety having at least six carbon atoms, and n is an integer from about 10 to 100.

A preferred deflocculating polymer is a copolymer of acrylic acid and maleic acid which is polymerized in the presence of dodecylmercaptan (DDM) to provide a hydrophobically-terminated copolymer having a molar ratio of about 100:1 to 25:1 of (acrylic acid:maleic acid):DDM, such that n is about 10 to 50, and the polymer has a weight average molecular weight of about 1,000 to 20,000.

The deflocculating polymer may optionally contain other, non-carboxylic acid comonomers in amounts up to 20%, preferably up to 5%, by weight, of the total monomer content. Furthermore, the hydrophobically-terminated polymer may be a homopolymer of acrylic acid or other carboxylic acid monomer.

The liquid detergent compositions containing an effective amount, about 0.01 to 5%, by weight, of the deflocculating polymer of the invention are characterized by a viscosity which is at least 50% less than the viscosity of the liquid detergent composition without the polymer of the invention. At usage levels of about 1 to 10%, preferably 2 to 5%, by weight, of liquid detergent compositions, the polymers of the invention wherein A and B are different monomers function as a detergent builder or as a co-builder. At levels above about 5%, by weight, the polymer of the invention increases the viscosity of liquid detergent composition and stabilizes the liquid phases through a thickening mechanism.

DESCRIPTION OF THE PREFERRED EMBODIMENTS

Detergent Compositions

Typical liquid detergent formulations which may be improved by the addition of the hydrophobically-terminated polymers of this invention are disclosed in U.S. Pat. Nos. 5,147,576, issued Sep. 15, 1992, to Montague, et al.; 5,132, 053, issued Jul. 21, 1992 to Crossin; 5,110,506, issued May 5, 1992 to Ciallella; 4,923,635, issued May 8, 1990 to Simion, et al.; 4,873,012, issued Oct. 10, 1989, to Broze, et al.,; 4,663,071, issued May 5, 1987 to Bush, et al.; and 4,906,397, issued Mar. 6, 1990 to Leighton, et al.; which are hereby incorporated by reference.

In a preferred embodiment, the hydrophobically-terminated polymer is incorporated into a liquid household laundry detergent formulation, comprising, by weight, 5–50% surfactant(s), 2–55% builder(s), and 15–95% of a combination of optional ingredients, such as buffers, enzymes, softeners, antistatic agents, fluorescers, dyes, perfumes, water and fillers. The hydrophobically-terminated polymer is used at 0.01 to 5.0%, preferably 0.05 to 2.0%, by weight, of the detergent formulation. Also included herein are any detergent formulations, used commercially or experimentally, which employ electrolytes in an aqueous continuous phase, including a phosphate co-builder or phosphate-replacer builder or co-builder (e.g., citrate or zeolite) or any builder which functions chiefly to sequester calcium, magnesium, barium and other polyvalent cations present in hard water. Formulations employing mixtures of builders, including phosphate-containing mixtures, are also useful. The hydrophobically-terminated polymer may be used as a co-builder, a builder, an anti-redeposition agent, an anti-incrustation agent, and as a processing aid in these detergents, in addition to its use as a rheology modifier and a stabilizer during detergent manufacture as well as in the final product.

Optional components of the detergent formulations include, but are not limited to, ion exchangers, alkalies, anticorrosion materials, anti-redeposition materials, optical brighteners, fragrances, dyes, fillers, chelating agents, enzymes, fabric whiteners and brighteners, sudsing control agents, solvents, hydrotropes, bleaching agents, bleach precursors, buffering agents, soil removal agents, soil release agents, fabric softening agent and opacifiers.

These optional components may comprise up to about 90%, by weight, of the detergent formulation, preferably 0 to 50%, most preferably 1 to 25%, of the detergent formulation.

The detergent compositions of this invention may take any of the physical forms associated with detergent compositions. They may be produced by any of the techniques commonly employed in the manufacture of detergent compositions. The hydrophobically-terminated polymer may be incorporated into the liquid composition at any stage of processing, but, when used for viscosity reduction and for liquid phase stability, is preferably added after the detergent active component(s) has been added to the electrolyte-containing aqueous phase. The practitioner will recognize which formulations are best suited to the physical form selected for a particular detergent composition and adjust the formulation accordingly.

The stability of concentrated detergent active materials (i.e., at least 25% by weight detergent active materials) in liquid detergent compositions is particularly enhanced by the use of 0.01 to 2.0%, preferably 0.1 to 1.0%, by weight, hydrophobically-terminated polymer.

Preferably, the viscosity of the aqueous continuous phase is less than 25 mPas, most preferably less than 15 mPas, especially less than 10 mPas, these viscosities being measured using a capillary viscometer, for example an Ostwald viscometer.

Sometimes, it is preferred for the compositions of the present invention to have solid-suspending properties (i.e. capable of suspending solid particles). Therefore, in many preferred examples, suspended solids are present. However, sometimes it may also be preferred that the compositions of the present invention do not have solid suspending properties.

In liquid detergent formulations, the term "deflocculating" polymer means that the equivalent liquid detergent composition, minus the polymer, has a significantly higher viscosity and/or becomes unstable. It is not intended to embrace polymers which would increase the viscosity and not enhance the stability of the composition. It is also not intended to embrace polymers which would lower the viscosity simply by a dilution effect, i.e. only by adding to the volume of the continuous phase. Nor does it include those polymers which lower viscosity only by reducing the volume fraction (shrinking) of the lamellar droplets, as disclosed in European patent application EP 301 883.

Thus, within the ambit of the present invention, relatively high levels of the deflocculating polymers can be used in those systems where a viscosity reduction is brought about; and, typically, levels as low as from about 0.01% by weight to about 1.0% by weight can be capable of reducing the viscosity at 21 $s^{-1}$ by up to 2 orders of magnitude.

Without being bound by any particular interpretation or theory, Applicant has hypothesized that the polymers exert their action on the composition by the following mechanism. The hydrophobic terminal groups (or caps) could be incorporated only in the outer bi-layer of the droplets, having the hydrophilic backbone over the outside of the droplets and additionally the polymers could also be incorporated deeper inside the droplet.

When the hydrophobic terminal caps are only incorporated in the outer bilayer of the droplets, this has the effect of decoupling the inter- and intra-droplet forces, i.e., the difference between the forces between individual surfactant molecules in adjacent layers within a particular droplet and those between surfactant molecules in adjacent droplets could become accentuated in that the forces between adjacent droplets are reduced. This will generally result in an increased stability due to less flocculation and a decrease in viscosity due to smaller forces between the droplets resulting in greater distances between adjacent droplets.

When the polymers are incorporated deeper inside the droplets also less flocculation will occur, resulting in an increase in stability. The influence of these polymers within the droplets on the viscosity is governed by two opposite effects: (1) the presence of deflocculating polymers will decrease the forces between adjacent droplets, resulting in greater distances between the droplets, generally resulting in a lower viscosity of the system; and (2) the forces between the layers within the droplets are equally reduced by the presence of the polymers in the droplet, this generally results in an increase in the water layer thickness, therewith increasing the lamellar volume of the droplets, and increasing the viscosity. The net effect of these two opposite effects may result in either a decrease or an increase in the viscosity of the product.

When a reduction in viscosity is required for processing or consumer handling of the detergent, the deflocculating polymer (the hydrophobically-capped polymer of this invention) is used in a detergent composition at an amount effective for yielding at least a 50% reduction in viscosity of the detergent composition which does not contain the deflocculating polymer. These effects are observed typically in concentrated liquid detergents at a polymer usage level of 0.01 to 2.0% by weight, preferably 0.05 to 1.0%.

When thickening is desired to maintain suspended particles, to act as a co-builder, or to stabilize the liquid phases of conventional liquid detergents, the hydrophobically-terminated polymer is used in an amount effective to suspend and/or stabilize incompatible or unstable materials. These effects are observed typically at a polymer usage level of about 1 to 10%, preferably 2 to 5%, by weight, depending upon the type of detergent composition.

For liquid phase stability in either a deflocculating or thickening mode, a "stable" liquid detergent composition is a composition which yields no more than 2%, by volume, visually-observed phase separation following storage at 25° C. for one month.

Polymers

Polymers useful herein include hydrophobically-terminated polycarboxylates. The polymers comprise a repeating unit of the structure: $[A—B]_n—C$, wherein A and B are polymerized residue(s) of ethylenically unsaturated carboxylic acid monomer(s), selected from the group consisting of monocarboxylic acid monomer(s), dicarboxylic acid monomer(s), and their salts, anhydrides and esters, and A and B may be identical or different, C is a terminal hydrophobe moiety containing an alkyl or aryl group of at least six carbon atoms and n is an integer from 10 to 100.

The polymers may comprise up to about 20%, preferably up to 5%, on a total monomer weight basis, of an optional, non-carboxylic acid monomer(s) moiety, such as the polymerized residue of ethylenically-unsaturated, water soluble monomer(s), including, but not limited to, esters of carboxylic acids (e.g., methylacrylate), sulfonic acids (e.g., sulfonated styrene), hydroxy alkylacrylates (e.g., ethyl or propyl), and other copolymerizable comonomers (e.g., acrylamide). Such moieties may be present along the polycarboxylic acid backbone of the polymer, but not at the ends of the polymer. In addition, such moieties may be incorporated only in amounts which do not alter the basic hydrophilic backbone/hydrophobic cap structure of the polymer and do not have an adverse impact on the utility of the polymer as a rheology-modifier in liquid detergent compositions.

The carboxylic monomers useful in the production of the polymers of this invention are the olefinically unsaturated carboxylic acids containing at least one activated carbon-to-carbon olefinic double bond, and at least one carboxyl group, that is, an acid containing an olefinic double bond which readily functions in polymerization because of its presence in the monomer molecule either in the alpha-beta position with respect to a carboxyl group, or as a part of a terminal methylene grouping. Olefinically-unsaturated acids of this class include such widely divergent materials as the acrylic acids typified by acrylic acid itself, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, citraconic acid, mesaconic acid, glutaconic acid, aconitic acid, maleic acid, fumaric acid, and tricarboxy ethylene. As used herein, the term "carboxylic acid" includes the polycarboxylic acids and those acid anhydrides, such as maleic anhydride, wherein the anhydride group is formed by the elimination of one molecule of water from two carboxyl groups located on the same polycarboxylic acid molecule.

Salts of these carboxylic acid monomers which are useful herein include those obtained by dissolving the monomer (in anhydride form) in water and neutralizing it with, e.g., sodium hydroxide. Neutralization may also be conducted following polymerization. The sodium, potassium, ammonium, monoethanolamine or triethanolamine carboxylate salts of the polymer are preferred.

Maleic anhydride and the other acid anhydrides useful herein may contain a substituent, such as hydrogen, halogen or hydroxyl or alkyl, aryl, alkaryl, aralkyl, and cycloalkyl groups, such as methyl, ethyl, propyl, octyl, decyl, phenyl, tolyl, xylyl, benzyl, cyclohexyl, and the like, provided the substituent comprises no more than 8 carbon atoms, preferably no more than 4 carbon atoms, and the backbone remains hydrophilic and substantially free of hydrophobic side chains. The preferred carboxylic monomers for use in this invention are the monoolefinic acrylic acids having a substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. Of this class, acrylic acid itself is most preferred because of its generally lower cost, ready availability, and ability to form superior polymers. Another particularly preferred carboxylic monomer is maleic anhydride.

Structure C, the hydrophobic moiety is derived from reagents which function as chain-termination agents during polymerization and react with the polymer to form a hydrophobically-capped polymer chain. Preferred reagents include $C_6$–$C_{30}$ mercaptans, most preferably $C_8$–$C_{18}$ alkyl, aryl or alkaryl mercaptans, esters or alcohols, and combinations thereof.

EXAMPLE 1

The polymers of this invention were prepared as described below and in Tables I and II.

Dodecylmercaptan Polymerization (Sample 16)

An initial charge of 98 g maleic anhydride (1.0 moles) in 300 g deionized water and 100 g isopropyl alcohol was brought to reflux in a two-liter reaction flask. A mixture of 252 g acrylic acid (3.5 moles) and 9.9 g dodecylmercaptan (DDM) was slowly added to the initial charge over a 3 hour period. A total of 7.6 g sodium persulfate in 120 g deionized water (2.0% w/w on a monomer basis) was slowly added to the initial charge over a 3½ hour period. The reaction mixture was then held for one hour and an azeotrope of water and alcohol (175 g) was collected under vacuum. A total of 420 g of a 50% w/v sodium hydroxide solution and 290 g of deionized water were added to yield a polymer solution having 36.7% solids and a pH of 7.4.

The same polymerization was used for all samples containing DDM except the mole ratios shown in Tables I and III were substituted for the above ratios. For the AA:DDM polymers, the initial charge contained no maleic monomer.

Lauryl methacrylate Polymerization (Sample 13) (Comparative Example)

An initial charge of 98 g maleic anhydride (1.0 moles) in 300 g deionized water and 100 g isopropyl alcohol was brought to reflux in a two liter reaction flask. A mixture of 252 g acrylic acid (3.5 moles) and 12 g lauryl methacrylate (0.047 moles) was slowly added to the initial charge over a 3 hour period. A total of 7.6 g sodium persulfate in 120 g deionized water (2.0% w/w on monomer) was slowly added to the initial charge over a 3½ hour period. The reaction mixture was then held for one hour and an azeotrope (155 g) was collected under vacuum. A total of 420 g of a 50% w/w sodium hydroxide solution and 240 g of deionized water were added to yield a polymer solution having 38.1% w/w solids and a pH of 7.4.

hydrophobe cap (i.e., 100:1 (AA:MA):DDM or 100:1 AA:DDM) were better phase stabilizers than either the polymers containing higher ratios of hydrophobe cap (i.e., 25:1 (AA:MA):DDM or 25:1 AA:DDM) or the control polymer comprising hydrophobic side chains.

TABLE I (A) Detergent Composition:40/60/20/1 Percent active/water/citrate/polymer 30 Day Detergent Tests

| Sample | Polymer Compositions Mole Ratio[a] | S.V.[b] (cps) | Viscosity, 5 min mPas | % Phase Separation | Bottom Phase |
|---|---|---|---|---|---|
| 1) | 25:1 (AA:MA):DDM | 5.10 | 89.0 | 28 | turbid |
| 2) | 50:1 (AA:MA):DDM | 7.80 | 110 | 25 | very turbid |
| 3) | 100:1 (AA:MA):DDM | 4.65 | 96.5 | 0 | — |
| 4) | 25:1 (AA:DDM) | 8.30 | 115 | 24 | very turbid |
| 5) | 25:1 (AA:DDM) | 8.90 | 121 | 24 | turbid |
| 6) | 50:1 (AA:DDM) | 5.60 | 105 | 28 | very turbid |
| 7) | 100:1 (AA:DDM) | 4.95 | 105 | 0 | — |
| 8) Control | 25:1 (AA:LMA) | 8.60 | 85.1 | 26 | very turbid |
| No polymer | — | — | 2,550 | 31 | clear |

[a]AA is acrylic acid; MA is maleic anhydride; DDM is dodecylmercaptan and LMA is lauryl methacrylate. Polymer preparation is described in Example 1. The mole ratio of (AA:MA) is 3:5:1 in samples 1–3.
[b]Estimated molecular weight was determined by a solution viscosity measurement. A 15% w/w solution of polymer in 1.0 N NaCl was measured on a Brookfield viscometer (Model LVT, with U.V. adapter) at 60 rpm and 25° C. Results are reported as solution viscosity (S.V.) in cps. Thses viscosities represent weight average molecular weights in the range of about 1,000 to 20,000.

Example 2

The polymers of Table I were tested in a model liquid detergent formulation for deflocculating and liquid stabilization effects.

The polymers were screened according to the procedure detailed in J. van de Pas' PhD dissertation entitled "A Study of the Physical Properties of Lamellar Liquid-Crystalline Dispersions" (Rijksuniversiteit Groningen, The Netherlands, Jun. 25, 1993). The polymers were screened at a solids level of 1% in a 40/60/20 active detergent agent/water/citrate builder system. The active ratio was 7/3 dodecylbenzenesulphonate (NaDoBS)/nonionic, and the order of addition was water, citrate builder (electrolyte), active, and the polymer. The systems containing the experimental polymers were compared both to a system containing control decoupling polymer and to a system containing no polymer.

Observations and physical stability measurements were made at one day, seven day, and thirty day time intervals. These evaluations included viscosity measurements, observations of percent phase separation and appearance of the bottom phases.

Results for the thirty day interval are shown in Table I. All of the hydrophobically terminated polymers of this invention were effective as stabilizers and deflocculating or decoupling agents in the liquid detergent system. At a 1% polymer usage level, the polymers containing lower ratios of The polymers herein also demonstrated viscosity and turbidity characteristics desirable in liquid detergent formulations and similar to control polymer characteristics. In contrast, the control containing no polymer was very viscous and clear.

Example 3

The liquid detergent stability test of Example 2 was used to test detergent formulations containing variable amounts of citrate builder and variable amounts of the polymers listed in Table I. Results are shown in Table II for one, seven and thirty day intervals in detergent formulations (A) and (B).

These results demonstrate that at usage levels of 0.5 and 1.0% the hydrophobically-capped polymers of the invention are effective deflocculating or decoupling agents in liquid detergents containing a high percentage of surfactant (active) and variable amounts of electrolyte (citrate builder). Viscosity remained at an acceptable level, relative to the controls, throughout the storage tests. Polymers containing a lower mole ratio of hydrophobe (i.e., 100:1 (AA:MA):DDM) were more effective phase stabilizers than higher mole ratio hydrophobe polymers (i.e., 25:1) in the presence of a higher percent citrate builder (i.e., 20 vs 15%). In all samples the amount of phase separation was acceptable and the polymers showed an improvement over the control formulation containing no polymer.

TABLE II

| Polymer Sample[a] | Detergent Tests 1 Day Viscosity[b] | 1 Day % Phase[c] Separation | 1 Day Bottom[c] Phase | 7 Day Viscosity[b] | 7 Day % Phase[c] Separation | 7 Day Bottom[c] Phase | 30 Day Viscosity[b] | 30 Day % Phase[c] Separation | 30 Day Bottom[c] Phase |
|---|---|---|---|---|---|---|---|---|---|
| (A) Detergent Composition:40/60/20/0.5% active/water/citrate/polymer | | | | | | | | | |
| 1) | 102 | 0 | none | 90.3 | 0 | none | 95.3 | 0 | none |
| 2) | 92.7 | 0 | none | 92.7 | 0 | none | 100 | 0 | none |
| 3) | 104 | 0 | none | 95.2 | 0 | none | 95.2 | 28 | turbid |
| 4) | 117 | 0 | none | 110 | 0 | none | 114 | 0 | none |
| 5) | 117 | 0 | none | 110 | 0 | none | 115 | 0 | none |
| 6) | 112 | 0 | none | 104 | 0 | none | 104 | 0 | none |
| 7) | 105 | 0 | none | 104 | 0 | none | 109 | 0 | none |
| 8) | 97.8 | 0 | none | 84.0 | 0 | none | 90.2 | 0 | none |
| No polumer | 2,080 | 18 | clear | 2,410 | 24 | clear | 1,940 | 32 | clear |
| (B) Detergent Composition:40/60/15/1% active/water/citrate/polymer | | | | | | | | | |
| 1) | 210 | 0 | none | 233 | 5 | turbid | 274 | 12 | turbid |
| 2) | 107 | 0 | none | 110 | 9 | turbid | 124 | 19 | turbid |
| 3) | 100 | 0 | none | 69 | 0 | none | 111 | 6 | turbid |
| 4) | 122 | 0 | none | 112 | 9 | turbid | — | 6 | turbid |
| 5) | 127 | 0 | none | 152 | 7 | turbid | — | 8 | turbid |
| 6) | 119 | 0 | none | 131 | 5 | turbid | — | 6 | turbid |
| 7) | 97.8 | 0 | none | 110 | 0 | none | — | 0 | none |
| 8) | 107 | 0 | none | 127 | 0 | none | — | 13 | turbid |
| No polymer | 1,640 | 17 | clear | 1,270 | 25 | clear | — | 29 | clear |

[a]See Table I.
[b]Viscosity units are 5 min mPas.
[c]Visual observations.

Example 4

The polymers of Table III were tested for calcium binding capacity to determine the polymers efficacy as liquid detergent builders.

Polymer samples were tested for calcium binding constant by the method of EP-A-1,137,669, using a calcium specific ion electrode.

Solutions of the materials to be tested (0.4% active polymer) were prepared, and the pH adjusted to 10. The calcium specific ion electrode was standardized using $CaCl_2$ solutions of 1, 10, 100 and 250 ppm Ca as $CaCO_3$, all containing 0.02N KCl. The calcium and reference electrodes were immersed in 25 ml of the 0.4% solutions of the materials to be tested, and standard 0.05M. $CaCl_2$ was added 1 ml at a time, until the concentration of Ca in solution exceeded 100 ppm. A plot of ml $CaCl_2$ added versus free $10^{-3}$M Ca (100 ppm $CaCO_3$) was extrapolated to zero free Ca concentration and this quantity of added calcium was used to determine the calcium binding capacity, in mg $CaCO_3$ per g of polymer. The results were reported per active weight of polymer.

The results, shown in Table III, establish that the hydrophobically terminated polymers of this invention have a suitable calcium binding capacity to function effectively as liquid detergent builders in comparison with Sample 18), a control polymer presently used as a builder in liquid detergents and Sample 13)–15), controls used as decoupling polymers in liquid detergents.

TABLE III

| Sample | Polymer Compositions Mole Ratio[a] | S.V.[b] (cps) | Calcium Binding Capacity[c] mg/$CaCO_3$/g polymer |
|---|---|---|---|
| 9) | 25:1 (AA:DDM) | 7.20 | 319 |
| 10) | 50:1 (AA:DDM) | 6.40 | 288 |
| 11) | 13:1 (AA:DDM) | 7.40 | 299 |
| 12) | 100:1 (AA:DDM) | 5.50 | 375 |
| 13) Control | 99:1 (AA:MA):LMA | 8.80 | 285 |
| 14) Control | 99:1 (AA:MA):LMA | 8.15 | 293 |
| 15) Control | 98.2 (AA:MA):LMA | 8.20 | 297 |
| 16) | 100:1 (AA:MA):DDM | 9.00 | 323 |
| 17) | 50:1(AA:MA):DDM | 9.20 | 342 |
| 18) Control | 3.5:1 AA:MA | 12.5 | 420 |

[a]AA is acrylic acid; MA is maleic anhydride; DDM is dodecylmercaptan; and LMA is lauryl methacrylate. Polymer preparation is described in Example 1. The (AA:MA) mole ratio in all samples containing (AA:MA) is 3.5:1.
[b]Estimated molecular weight was determined by a solution viscosity measurement. A 15% w/w solution of polymer in 1.0 N NaCl was measured on a Brookfield viscometer (Model LVT, with U.V. adapter) at 60 rpm and 25° C. Results are reported as solution viscosity (S.V.) in cps. These viscosities represent weight average molecular weights in the range of about 1,000 to 20,000.
[c]See Example 4 for a description of the test.

Example 5

Liquid detergent compositions are formulated as described below using the hydrophobically-terminated polymers of this invention.

| Component | Liquid Detergent Formula A Weight Percent 1 | 2 | 3 | 4 |
|---|---|---|---|---|
| Sodium Citrate | 17.2 | 17.2 | 17.2 | 17.2 |
| Ethoxylated $C_{12}$–$C_{13}$ alcohol (6.5 moles EO/mole alcohol) | 17.6 | 17.6 | 22.0 | 7.0 |
| Cocoamido betaine[a] | 3.1 | 3.1 | — | 9.0 |
| Nonyl succinic anhydride[b] Potassium salt) | 7.0 | 7.0 | 14.0 | — |
| Polymer of Example 1 | 0.01–2.0 | 0.01–2.0 | 0.01–2.0 | 0.01–2.0 |
| Brightener and dye | 0.2 | — | — | — |
| Water | Balance | Balance | Balance | Balance |

[a]Provided as "Varion CADG", an aqueous solution of cocoamideo betaine sold by Sherex Chemical Company.
[b]The anhydride is obtained from American Hoechst COmpany, and reacted with potassium hydroxide to form the potassium salt.

Formula B

| Component | Weight Percent |
|---|---|
| Tergitol Nonionic Surfactant 24-L-6ON[a] | 16.00 |
| Alkaril QCJ (15% aqueous solution)[b] | 6.67 |
| Fluorescent brightener[c] | 0.16 |
| Sodium linear dodecylbenzene sulfonate (52.5% active ingredient, in aqueous solution) | 6.67 |
| Enzyme mixture (Alcamyl) | 0.75 |
| Calcium chloride dihydrate | 0.17 |
| Sodium formate | 3.00 |
| Sodium nitrate | 0.50 |
| Blue dye (Cl Acid Blue 182, 0.38% aqueous solution) | 1.00 |
| Ethanol (denatured with methanol) | 5.41 |
| Perfume | 0.35 |
| Sodium hydroxide (38% aqueous NaOH solution | q.s. |

-continued

Formula B

| Component | Weight Percent |
|---|---|
| for pH adjustment | |
| Citric acid (50% aqueous solution), for pH adjustment | q.s. |
| Polymer of Example 1 | 0.01–2.0 |
| Water (softened) | Balance |

[a]A narrow range ethoxylate n onionic detergent which is a condensation product of higher fatty alcohol of 12–14 carbon atoms and an average of 7 moles of ethylene oxide per mole, with over 90% thereof of 4–10 ethoxylate groups per mole.
[b]Polyethylene terephthalate-polyoxyethylene terephthalate copolymer of molecular weight of about 22,000, polyoxyethylene molecular weight of about 3,400, and molar ratio of polyethylene terephthalate to polyoxyethylene terephthalate units of about 3:1.
[c]Stilbene-type fluorescent brighteners (0.11% of Phorwite RKH and 0.05% of Phorwite BHC, obtained from Mobay Chemical Co.).

Formula C

| Component | Weight Percent 1 | 2 |
|---|---|---|
| Magnesium linear dodecyl benzene sulfonate | 19.4 | 15.9 |
| Sodium linear dodecyl benzene sulfonate | 1.3 | 1.1 |
| Ammonium[a] $C_{12}$–$C_{15}$ alkyl triethenoxy ether sulfate | 18.0 | 13.0 |
| Lauric-myristic monoethanolamide | 4.0 | 4.0 |
| Triethanolamine | 1.2 | q.s. |
| Sodium xylene sulfonate | 2.4 | 2.4 |
| Sodium cumene sulfonate | 0.7 | 0.9 |
| Ethanol | 4.3 | 4.3 |
| Color, perfume | q.s. | q.s. |
| Polymer of Example 1 | 0.01–2.0 | 0.01–2.0 |
| Water | balance | balance |

[a]Sodium salt may be used in place of the ammonium salt.

Formula D

| Component | Weight in Percent 1 | 2 | 3 | 4 | 5 | 6 |
|---|---|---|---|---|---|---|
| Actives | | | | | | |
| Sodium $C_{11}$–$C_{15}$ Alkylbenzene Sulfonate | 8 | 17 | 10 | — | — | 7 |
| Alcohol Ethoxy Sulfate[a] | 12 | — | 6 | — | — | 1 |
| Alcohol Ethyoxylate[b] | 8 | 7 | 8 | 16 | 8 | 4 |
| Alkylpolyglycoside[c] | — | — | — | — | 16 | 15 |
| Builders | | | | | | |
| Trisodium Citrate | 0–15 | 0–15 | 0–10 | 0–20 | 10 | 10 |
| Soap | 0–10 | 0–15 | — | — | 5 | 4 |
| Carboxymethyloxysuccinate, trisodium | — | — | — | — | 10 | 0–20 |
| Oxydisuccinate, tetrasodium | — | — | — | — | — | 6 |
| Buffers | | | | | | |
| Monoethanolamine | 1 | 2 | 2 | 0–4 | — | 2 |
| Triethanolamine | — | — | 2 | — | 4 | 4 |
| Sodium Carbonate | — | — | — | — | — | 1 |
| Enzymes | | | | | | |
| Protease (Savinase, Alcalase, etc.) | 1 | — | 1 | 0.5 | 1 | 0.75 |
| Amylase (Termamyl) | 0.5 | — | — | 0.5 | 1 | 0.5 |
| Lipase (Lipolase) | 1 | — | — | 0.5 | 1 | 1 |
| Enzyme Stabilizers | | | | | | |
| Borax Pentahydrate | — | — | 3.5 | — | 5 | 4 |

-continued

| Formula D | | | | | | |
|---|---|---|---|---|---|---|
| | Weight in Percent | | | | | |
| Component | 1 | 2 | 3 | 4 | 5 | 6 |
| Glycerol | — | — | 4 | — | 6 | 5 |
| Propylene Glycol | 10 | — | — | 10 | 2 | 5 |
| Formic Acid | 1 | — | — | 1 | — | 1 |
| Calcium Chloride | 1 | — | 1 | 1 | 1 | 1 |
| Softeners & Antistats | | | | | | |
| Quaternary Amines (Arquad 2HT) | — | — | — | 2 | — | — |
| Ethoxylated Amine[d] | 1 | — | — | 2 | 1 | — |
| Alkyldimethyl Amine Oxide[e] | — | — | — | 1.5 | — | — |
| Compatibilizing Agents | | | | | | |
| Na Xylene Sulfonates | 3 | 6 | 3 | 2 | — | 3 |
| Ethanol | 10 | — | 2 | 8 | 3 | 3 |
| Fluorescers | 0.25 | 0.2 | 0.25 | 0.25 | 0.2 | 0.15 |
| Perfume | 0.2 | 0.15 | 0.1–0.3 | 0.2 | 0.25 | 0.1–0.25 |
| Polymer of Example 1[f] | 0.01–2 | 0.01–2 | 0.01–2 | 0.01–2 | 0.01–2 | 0.01–2 |
| Water | To balance | | | | | |

[a]Sulfated Alfonic ® 1412-60 (12–14 C alcohol ethoxylate, containing 60% ethylene oxide by weight, sodium salt.)
[b]Alfonic ® 1412-70 (12–14 C alcohol) ethoxylate.
[c]APG 300 (obtained from Horizon Chemical).
[d]Varonic ® U202 (obtained from Sherex Corporation).
[e]Ammonyx MO (obtained from Stepan Chemical).
[f]See Example 1 for preparation and description of polymer.

| Formula E | | |
|---|---|---|
| | Weight Percent | |
| Component | 1 | 2 |
| Na Dobs | 10.2 | — |
| K Dobs | — | 10.7 |
| Synperonic A7 | 19.3 | 19.3 |
| Na Oleate | 10.3 | — |
| K Oleate | — | 10.9 |
| Glycerol | 5.0 | 5.0 |
| Borax | 3.5 | 3.5 |
| Na-citrate | 10.0 | — |
| $Na_2CO_3$ | — | 4.0 |
| Sokalan CPS polyacrylate | 2.5 | — |
| Dequest 2066 (s 100%) | 0.4 | 0.4 |
| Silicon DB100 | 0.3 | 0.3 |
| Tinopal CBS-X | 0.5 | 0.5 |
| Savinase | 0.3 | 0.3 |
| Amylase | 0.1 | 0.1 |
| Perfume | 0.1 | 0.1 |
| Dye | 0.3 | 0.3 |
| Deflocculating polymer of Example 1 | 1.0 | 1.0 |
| Water | Balance (to 100) | |

| Formula F | | |
|---|---|---|
| | Weight Percent | |
| Component | 1 | 2 |
| Na Dobs | 11.0 | 12.3 |
| Synperonic A7 | 13.8 | 15.4 |
| Na Oleate | 6.7 | 7.5 |
| Na Laurate | 4.6 | 5.1 |
| $Na_2CO_3$ | 4.0 | — |
| $K_2SO_4$ | — | 6.0 |
| Glycerol | 5.0 | 5.0 |
| Borax | 3.5 | 3.5 |
| Dequest 2066 (as 100%) | 0.4 | 0.4 |
| Silicon DB100 | 0.1 | 0.1 |
| Savinase | 0.3 | 0.3 |

-continued

| Formula F | | |
|---|---|---|
| | Weight Percent | |
| Component | 1 | 2 |
| Amylase | 0.1 | 0.1 |
| Tinopal CBS-X | 0.1 | 0.1 |
| Perfume | 0.3 | 0.3 |
| Polymer of Example 1 | 0.5 | 0.5 |
| Water | up to 100 | up to 100 |
| pH | 9.7–10.0 | 8.3–8.8 |

| Formula G | | | | | |
|---|---|---|---|---|---|
| | Weight Percent | | | | |
| Component | 1 | 2 | 3 | 4 | 5 |
| NaDoBS | 9.6 | 9.4 | 9.2 | 8.9 | 8.3 |
| Na-Oleate | 15.9 | 15.6 | 15.3 | 14.7 | 13.7 |
| Synperonic A7 | 4.5 | 4.4 | 4.3 | 4.2 | 3.9 |
| Glycerol | 5.0 | 4.9 | 4.8 | 4.6 | 4.3 |
| Borax | 3.5 | 3.4 | 3.4 | 3.2 | 3.0 |
| KTP | — | 2.0 | 3.8 | 7.4 | 13.8 |
| STP | 15.0 | 14.7 | 14.4 | 13.9 | 12.9 |
| Silicon oil | 0.25 | 0.25 | 0.24 | 0.23 | 0.22 |
| Gasil 200 | 2.0 | 2.0 | 1.9 | 1.9 | 1.7 |
| Na-SCMC | 0.1 | 0.1 | 0.1 | 0.1 | 0.1 |
| Tinopal CBS-X | 0.1 | 0.1 | 0.1 | 0.1 | 0.1 |
| Perfume | 0.3 | 0.3 | 0.3 | 0.27 | 0.26 |
| Alcalase 2.5L | 0.5 | 0.5 | 0.5 | 0.46 | 0.43 |
| Polymer of Example 1 | 0.75 | 0.74 | 0.72 | 0.69 | 0.65 |
| Water | 42.5 | 41.6 | 40.9 | 39.4 | 36.6 |

The liquid detergents compositions are stable and exhibit desirable flow characteristics and viscosity.

Although emphasis has been placed on laundry detergent compositions in these examples, detergent compositions for all cleaning purposes are included within the scope of this invention. Various modifications and improvements on the compositions herein will become readily apparent to those skilled in the art. Accordingly, the scope and spirit of the invention are to be limited only by the claims and not by the foregoing specification.

We claim:

1. A liquid detergent composition consisting essentially of a lamellar dispersion of at least 25%, by weight, detergent active material(s) in an aqueous continuous phase at least 1%, by weight, electrolyte(s) contained in the aqueous continuous phase, about 0.01 to 5%, by weight, deflocculating polymer, water; and optionally one or more additional detergent component(s), all percents based on the total weight of the detergent composition, the deflocculating polymer comprising a hydrophobically-terminated, hydrophilic polymer having efficacy as a stabilizer wherein the deflocculating polymer comprises a repeating unit of the structure:

$$[A—B]_n—C,$$

wherein A and B are a polymerized residue of ethylenically unsaturated carboxylic acid monomer(s) selected from the group consisting of monocarboxylic acid(s), dicarboxylic acid(s) and their salts, anhydrides and esters, C is a terminal hydrophobic moiety derived from reagents which function as chain terminating agents during polymerization to form a hydrophobically-capped polymer chain, and wherein n is an integer from about 10 to 100, and wherein the liquid detergent composition yields no more than 2%, by volume, visual phase separation following storage at 25° C. for one month.

2. A liquid detergent composition consisting essentially of a lamellar dispersion of at least 5%, by weight, detergent active material(s) in an aqueous continuous phase, at least 1%, by weight, electrolyte(s) contained in the aqueous continuous phase, about 2 to 10%, by weight, detergent builder, water; and optionally, one or more additional detergent component(s), all percents based on the total weight of the detergent composition, the detergent builder comprising a hydrophobically-terminated, hydrophilic polymer comprising at least one monocarboxylic acid monomer and at least one dicarboxylic acid monomer, wherein the detergent builder comprises a repeating unit of the structure:

$$[A—B]_n—C,$$

wherein A and B each are a polymerized residue of ethylenically unsaturated carboxylic acid monomer(s) selected from the group consisting of monocarboxylic acid(s), dicarboxylic acid(s) and their salts, anhydrides and esters, A and B are different, C is a terminal hydrophobic moiety derived from reagents which function as chain terminating agents during polymerization to form a hydrophobically-capped polymer chain, and n is an integer from about 10 to 100, and wherein the liquid detergent composition yields no more than 2%, by volume, visual phase separation following storage at 25° C. for one month.

3. The liquid detergent composition of claim 1, wherein A is selected from the group consisting of acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3) esters, and salts, esters and combinations thereof.

4. The liquid detergent composition of claim 1, wherein B is selected from the group consisting of itaconic acid, citraconic acid, mesaconic acid, glutaconic acid, aconitic acid, maleic acid, fumaric acid, and tricarboxy ethylene and salts, anhydrides and esters thereof, and combinations thereof.

5. The liquid detergent composition of claim 1, wherein C is selected from the group consisting of $C_6$–$C_{30}$ alkyl, aryl or alkaryl mercaptans, esters and alcohols, and combinations thereof.

6. The liquid detergent composition of claim 1, wherein A is acrylic acid, B is maleic acid and C is dodecyl mercaptan.

7. The liquid detergent composition of claim 6, wherein n is 10 to 50.

8. The liquid detergent composition of claim 7, wherein the weight average molecular weight of the deflocculating polymer is 1,000 to 20,000.

9. The liquid detergent composition of claim 1, wherein the deflocculating polymer further comprises, in a non-terminal position, the polymerized residue of up to 20%, by weight, of at least one ethylenically unsaturated, non-carboxylic acid monomer.

10. The liquid detergent composition of claim 1, wherein the deflocculating polymer further comprises, in a non-terminal position, the polymerized residue of up to 5%, by weight, of at least one ethylenically unsaturated, non-carboxylic acid monomer.

11. The liquid detergent composition of claim 1, wherein the viscosity of the liquid detergent composition comprising the deflocculating polymer is at least 50% less than the viscosity of the liquid detergent composition without the deflocculating polymer.

12. The liquid detergent composition of claim 2, wherein the deflocculating polymer further comprises, in a non-terminal position, the polymerized residue of up to 5%, by weight, of at least one ethylenically unsaturated, non-carboxylic acid monomer.

13. The liquid detergent composition of claim 2, wherein the hydrophobically-terminated hydrophilic polymer is present in an amount effective to thicken and stabilize the liquid detergent composition and prevent liquid phase separation.

14. The liquid detergent composition of claim 2, wherein C is selected from the group consisting of $C_6$–$C_{30}$ alkyl, aryl or alkaryl mercaptans, esters and alcohols, and combinations thereof.

15. The liquid detergent composition of claim 2, wherein A is acrylic acid, B is maleic acid and C is dodecyl mercaptan.

16. The liquid detergent composition of claim 15, wherein n is 10 to 50.

17. The liquid detergent composition of claim 16, wherein the weight average molecular weight of the deflocculating polymer is 1,000 to 20,000.

18. The liquid detergent composition of claim 2, wherein the deflocculating polymer further comprises, in a non-terminal position, the polymerized residue of up to 20%, by weight, of at least one ethylenically unsaturated, non-carboxylic acid monomer.

* * * * *